US007081151B2

(12) United States Patent
Troschel et al.

(10) Patent No.: US 7,081,151 B2
(45) Date of Patent: Jul. 25, 2006

(54) ALLOY AND METHOD FOR PRODUCING SAME

(75) Inventors: Wolfgang Troschel, Wetzlar (DE); Ralf Toller, Neu-Anspach (DE)

(73) Assignee: SinterCast AB, Stockholm (SE)

( * ) Notice: Subject to any disclaimer, the term of this patent is extended or adjusted under 35 U.S.C. 154(b) by 221 days.

(21) Appl. No.: 10/149,653

(22) PCT Filed: Dec. 15, 2000

(86) PCT No.: PCT/SE00/02550

§ 371 (c)(1),
(2), (4) Date: Oct. 15, 2002

(87) PCT Pub. No.: WO01/44530

PCT Pub. Date: Jun. 21, 2001

(65) Prior Publication Data

US 2003/0102056 A1 Jun. 5, 2003

(30) Foreign Application Priority Data

Dec. 17, 1999 (SE) ..... 99046682

(51) Int. Cl.
*C22C 38/00* (2006.01)

(52) U.S. Cl. ..... 75/520; 148/321; 420/10

(58) Field of Classification Search ..... 420/13, 420/19, 20–22, 9, 10, 18; 148/321, 323; 75/520

See application file for complete search history.

(56) References Cited

U.S. PATENT DOCUMENTS 2,978,320 A * 4/1961 Larson et al. ..... 420/14
4,040,875 A * 8/1977 Noble ..... 148/321
4,874,576 A 10/1989 Reifferscheid
6,102,983 A * 8/2000 Skaland ..... 75/568

FOREIGN PATENT DOCUMENTS

SE 512 201 2/2000

OTHER PUBLICATIONS

Tsuda, M. et al., Foundrymen'sSociety Journal, abtract of "A study on the formation of abnormal structures in the Furan Resin mold interface of spheroidal graphite cast iron", Jul. 1979.*

* cited by examiner

*Primary Examiner*—Scott Kastler
(74) *Attorney, Agent, or Firm*—Nixon & Vanderhye P.C.

(57) ABSTRACT

It is possible to generate a desirable form (soft, pliable) of sulfide inclusions in magnesium-treated case irons. Thermodynamically, MnS and $MoS_2$ are not stable in the presence of magnesium. However, by adding magnesium to a cast iron melt containing manganese sulfide/molybdenium sulfide as late as possible, and preferably when the molten cast iron has been dispensed into the mould, such sulfide inclusions may be preserved in magnesium-treated cast iron. Alternatively, said cast iron can also be formed by adding said sulfides directly to the iron after the magnesium reaction has taken place and an in situ equillibrium has been established between magnesium, oxygen and sulfur. Another option is to begin with a sulfur content in excess of the stoichiometric amount required to combine with the added magnesium, thus ensuring an amount of left-over sulfur to promote the formation of the desired sulfide inclusion.

3 Claims, 1 Drawing Sheet

ALLOY AND METHOD FOR PRODUCING SAME

This application is the National Phase of International Application PCT/SE00/02550 filed 15 Dec. 2000 which designated the U.S.

The present invention relates to a novel magnesium-treated cast iron containing manganese sulfide (MnS) or molybdenium sulfide ($MoS_2$) inclusions. The invention also relates to a procedure for preparing the novel cast iron, cast iron products comprising the novel cast iron, as well as using the novel iron for manufacturing cylinder blocks, cylinder beads, bedplates, transmission housings, axle housings or brake drums and discs.

TECHNICAL BACKGROUND

Magnesium treated cast irons, such as compacted graphite iron (CGI) and ductile cast iron (SG) are widely used for a variety of applications. Unfortunately, however, in comparison to conventional grey cast iron these alloys are relatively difficult to machine. This factor has prevented their application to many high volume products which require large amounts of machining. One example is automotive cylinders blocks.

Although the higher strength, stiffness and ductility of CGI and SG relative to conventional grey cast irons accounts for much the difference in machinability between these materials, other factors may also be active. One such factor is the presence of 1–5 μm diameter manganese sulfide (MnS) inclusions in grey cast iron. These inclusions are known to adhere to the cutting edge of the machining tools, thus forming a protective layer and reducing tool wear. The effect is particularly significant at high cutting speeds (400–1000 m/min) when using cubic boron nitride (CBN) or ceramic cutting materials. It is also known that high sulfur and manganese additions improve the machinability of steels. Such steel alloys are referred to in the trade as "free-machining steels". Again, the mechanism for improved machinability relates to the formation of a protective MnS layer on the cutting insert and/or a lubricating effect of the sulfide inclusions between the cutting insert and the workpiece and/or chip.

Unfortunately, manganese sulfide inclusions are not stable in magnesium-treated cast irons due to the lower free-energy of magnesium sulfide at ironmaking temperatures (FIG. 1). Therefore, a previous patent (SE 9800750-3), incorporated by reference, disclosed a method to convert the existing $MgO.SiO_2$ inclusions in magnesium-treated cast irons to soft calcium-bearing inclusions. However, there are no available methods for producing a magnesium-treated cast iron alloy containing soft and pliable inclusions.

SUMMARY OF THE INVENTION

Now, it has surprisingly turned out that it is possible to generate a desirable form (soft, pliable) of sulfide inclusions in magnesium-treated cast irons. Thermodynamically, MnS and $MoS_2$ are not stable in the presence of magnesium. However, by adding magnesium to a cast iron melt containing manganese sulfide/molybdenium sulfide as late as possible, and preferably when the molten cast iron has been dispensed into the mould, such sulfide inclusions may be preserved in magnesium-treated cast irons. Alternatively, said cast iron can also be formed by adding said sulfides directly to the iron after the magnesium reaction has taken place and an in situ equilibrium has been established between magnesium, oxygen and sulfur. Another option is to begin with a sulfur content in excess of the stoichiometric amount required to combine with the added magnesium, thus ensureing an amount of left-over sulfur to promote the formation of the desired sulfide inclusions.

DETAILED DESCRIPTION OF THE INVENTION

Figure 1:
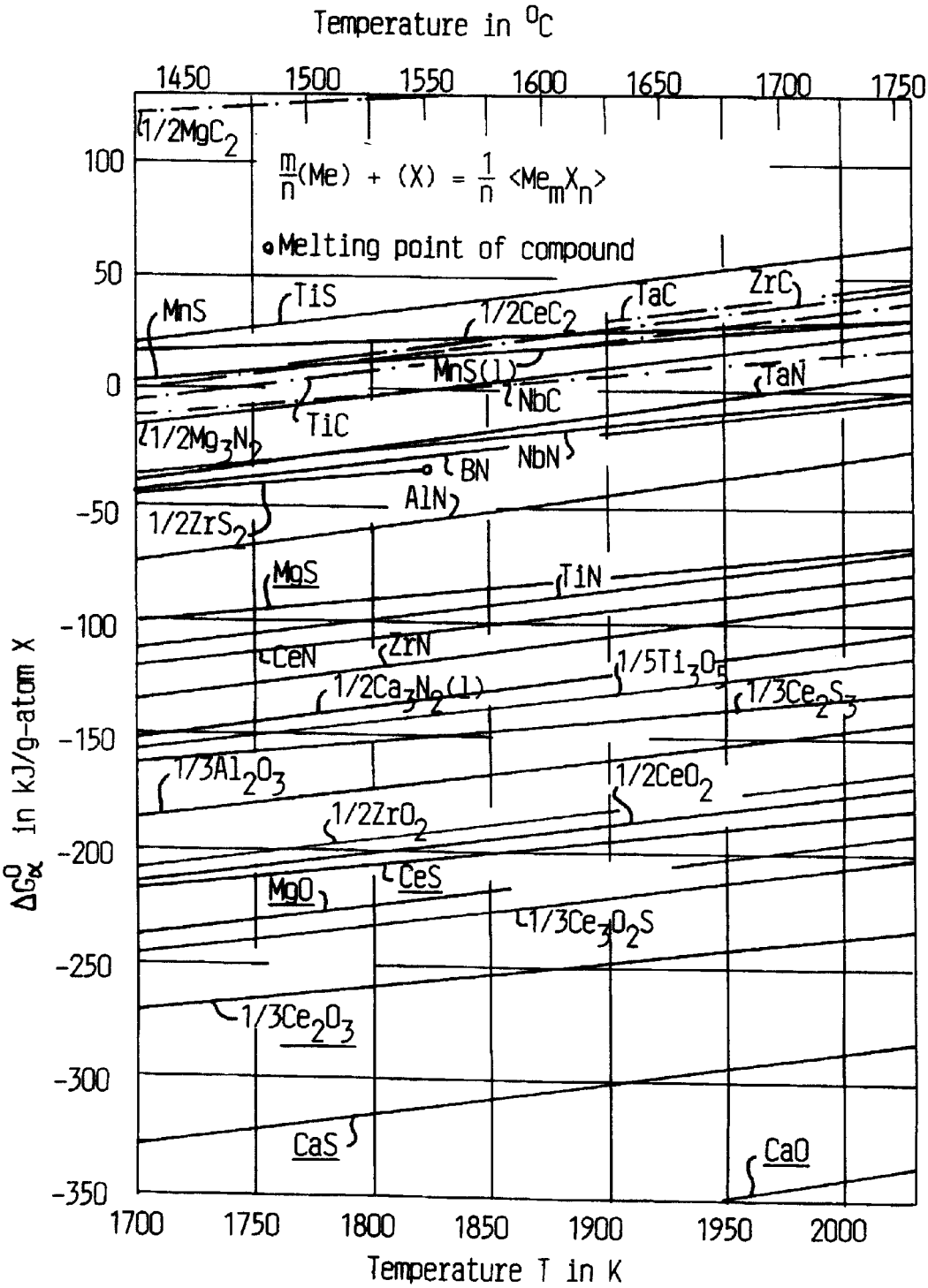
FIG. 1 is a chart showing temperature dependencies of free precipitation energies $\Delta G_s°$ for some oxides, sulfides, oxysulfides, nitrides and carbides in molten iron, according to an embodiment of the present invention.

As disclosed herein, the term "inclusion-forming compound" generally relates to all non-metallic non-organic compounds with hexagonal or face-centred cubic crystal structures and melting points of at least 1100° C. Preferably manganese sulfide or molybdenium sulfide is used in relation to the present invention.

Accordingly, the present invention relates to a magnesium-treated cast iron containing inclusions which either lubricate the cutting insert or contribute to the formation of a protective layer on the cutting edge of the insert. The inclusions preferably consist of manganese sulfide (MnS) or molybdenium sulfide ($MoS_2$). Typically, the sulfides are added to a molten base iron as 1–100 μm particles. In the presence of heat (1400–1500° C.), these particles will become individual spheroids with a uniformly distributed by the convection currents present in the molten iron. This base iron is then treated with magnesium at the last possible moment, preferably when the molten cast iron has been poured into a mould.

The present invention will be disclosed with reference to the enclosed FIG. 1 which shows temperature dependencies of free precipitation energies $\Delta G_s°$ for some oxides, sulfides, oxysulfides, nitrides and carbides in molten iron.

The theory behind the invention is the following: Prior to the addition of magnesium, an equilibrium will have been established between manganese and sulfur in the base iron as a function of the holding temperature. Once the addition of magnesium is made, the stronger sulfide capacity of the magnesium will reduce the MnS according to the reaction:

$$MnS+\underline{Mg}=MgS+\underline{Mn}$$

$$\Delta G°=-73 \text{ kJoules/mol at } 1450° \text{ C.}$$

The strongly negative free energy and the exothermic nature of the reaction, combined with the small size, high quantity (approximately $10^8$ MnS inclusions per tonne of liquid iron), suggests that reaction [1] proceeds rapidly to the right. It is therefore important to delay reaction [1] until the last possible moment to prevent reduction of the desired MnS inclusions. Thus, it is proposed that the magnesium addition be made as late as possible, preferably just before the iron is dispensed into the mould or in-the-mould itself.

The process according to the present invention starts with preparing a molten cast iron according to per se known methods with a typical base iron chemistry for ductile iron and for compacted graphite iron production:

| | | | |
|---|---|---|---|
| C: | 3.5–3.9% | S: | 0.005–0.020% |
| Si | 1.8–2.2% | Mn | 0.1–0.5% |

The presence of Mn and S in the base iron will naturally lead to the formation of MnS inclusions according to the thermodynamic equilibrium at the holding temperature. Thereafter, in contrast to typical ductile iron and CGI production techniques which may add the magnesium as much as ten minutes before the start-of-pour, the present invention requires that the molten cast iron is not treated with magnesium until the last possible moment before casting. The magnesium can be added immediately before dispensing the molten iron into the mould, but preferably the magnesium is added to the melt after dispensing the molten iron into the mould. In order to minimise formation of magnesium sulfide after the magnesium addition it is also possible to chill the mould filled with molten magnesium-treated and inclusion-containing cast iron, so that the solidification process is accelerated.

The amount of magnesium added in this step is calibrated in advance. Typically the magnesium content of the final cast iron melt is 0.001–0.030% (wt).

Alternatively, a post-addition of MnS particles, or other known solid lubricant particles, namely $MoS_2$, may be made to the iron after the magnesium reaction has taken place and an in-situ equilibrium has been established between magnesium, oxygen and sulfur. This will allow the MnS or $MoS_2$ particles to remain in the solidified casting. In this case, 1–100 μm manganese sulfide particles of are added. The addition of these particles result in an amount of manganese in the final melt of at least 0.1% (wt), and typically about 0.6%. An amount of of about 4 kg manganese sulfide per tonne molten cast iron is typically added, corresponding to $10^8$–$10^{12}$ inclusions per tonne molten cast iron, depending on the efficiency of dissolution and assimilation into the melt. A proposed composition for such a master alloy for adding either MnS or $MoS_2$ particles is as follows:

| | | | |
|---|---|---|---|
| Si: | 0–90% | Al: | 0–10% |
| Ca: | 0–10% | Ba: | 0–10% |
| Sr: | 0–10% | Zr: | 0–10% |
| Re: | 0–20% | Mn: | 10–90% |
| MnS: | 20–70% | $MoS_2$: | 20–70% |
| Fe: | 0–balance. | | |

Accordingly, this alternative method comprises the steps of a) preparing a molten base iron according to per se known methods; b) adding a predetermined amount of magnesium to the molten base iron and allowing establishment of an equilibrium between magnesium, oxygen and sulfur; c) adding a predetermined amount of manganese sulfide and/or molybdenium sulfide; and finally d) casting the melt according to per se known methods.

A final option for the stabilisation of MnS in the standard CGI or SG base iron is to increase the sulfur content beyond the typical level of 0.005–0.020% S. In this way, the higher amount of sulfur increases the probability that MnS will form, and indeed survive until the moment of solidification. Thus, the presence of 0.04% sulfur or more, in the CGI or SG base iron has been shown to result in the presence of MnS inclusions in the final cast products, thus improving their machinability.

The invention claimed is:

1. A method for producing a magnesium-treated cast iron containing manganese sulfide and/or molybdenum disulfide inclusions, which improve machinability by acting as either a lubricant for a cutting insert for a machine tool or contribute to the formation of a protective layer on a cutting edge of a machine tool when machining said cast iron, comprising:

a) preparing a molten base iron;

b) adding a predetermined amount of magnesium to the molten base iron and allowing establishment of an equilibrium between magnesium, oxygen and sulfur;

c) adding a predetermined amount of manganese sulfide and/or molybdenum disulfide; and d) casting the melt.

2. A method for producing a magnesium-treated cast iron containing manganese sulfide and/or molybdenum disulfide inclusions, which improve machinability by acting as either a lubricant for a cutting insert for a machine tool or contribute to the formation of a protective layer on a cutting edge of a machine tool when machining said cast iron, comprising:

a) preparing a molten base iron, said base iron containing at least 0.1% Mn;

b) increasing the amount of sulfur to at least 0.04%;

c) adding a predetermined amount of magnesium immediately just before dispensing the molten iron into a mould or adding magnesium after dispensing the molten iron into the mould; and d) casting the melt.

3. A method according to any one of claims 1-2, further comprising chilling the mould after the casting operation in order to maximise the amount of sulfide inclusions.

* * * * *